US008141604B2

(12) United States Patent
Emery et al.

(10) Patent No.: US 8,141,604 B2
(45) Date of Patent: Mar. 27, 2012

(54) METHOD OF MANUFACTURE FOR WOODEN GUNSTOCKS

(75) Inventors: Raymond R. Emery, Lincoln, ME (US); Donald Martin Perkins, Ronan, MT (US)

(73) Assignee: Hot Woods, LLC, Ronan, MO (US)

( * ) Notice: Subject to any disclaimer, the term of this patent is extended or adjusted under 35 U.S.C. 154(b) by 152 days.

(21) Appl. No.: 12/714,592

(22) Filed: Mar. 1, 2010

(65) Prior Publication Data

US 2011/0168298 A1 Jul. 14, 2011

Related U.S. Application Data

(63) Continuation-in-part of application No. 12/686,124, filed on Jan. 12, 2010.

(51) Int. Cl.
*B27M 1/00* (2006.01)
*F41C 23/00* (2006.01)

(52) U.S. Cl. ..... 144/364; 144/380; 42/71.01; 42/71.02

(58) Field of Classification Search ..... 144/356, 144/360, 363, 364, 380; 42/71.01, 71.02
See application file for complete search history.

(56) References Cited

U.S. PATENT DOCUMENTS

| | | | | |
|---|---|---|---|---|
| 1,376,917 | A * | 5/1921 | Bump | 42/71.01 |
| 1,525,892 | A * | 2/1925 | Schlosser et al. | 42/71.01 |
| 2,205,891 | A * | 6/1940 | Sprenger | 156/222 |
| 4,017,980 | A * | 4/1977 | Kleinguenther | 34/396 |
| 5,388,363 | A * | 2/1995 | Smart | 42/71.01 |
| 6,571,840 | B1 * | 6/2003 | Atkins et al. | 144/358 |
| 2011/0138670 | A1 * | 6/2011 | Phillips | 42/71.01 |
| 2011/0168297 | A1 * | 7/2011 | Emery et al. | 144/364 |

FOREIGN PATENT DOCUMENTS

EP 0922918 A1 6/1999

OTHER PUBLICATIONS

Lexis Nexis Copyright 1990 Gunstock Blanks; How to buy the Best; Gunsmithing Tips by Ron Swarley Oct. 1, 1990.*

* cited by examiner

*Primary Examiner* — Shelley Self
(74) *Attorney, Agent, or Firm* — Anthony D. Pellegrini

(57) ABSTRACT

An improved method for the manufacture of wooden gunstocks comprising the steps of first heat treating the wood and then fashioning the wood into a gunstock, whereby the resulting gunstock is more weather and rot resistant, more stable, and lighter than gunstocks fashioned from untreated wood.

20 Claims, 2 Drawing Sheets

METHOD OF MANUFACTURE FOR WOODEN GUNSTOCKS

CROSS REFERENCE TO RELATED APPLICATION

This application is a continuation in part of U.S. Ser. No. 12/686,124, filed Jan. 12, 2010 and currently pending, entitled Improved Method Of Manufacture For Wooden Gunstocks, by Emery, Raymond, et al., which is hereby incorporated by reference.

BACKGROUND OF THE INVENTION

1. Technical Field

The invention relates generally to the field of firearms and is directed to an improved method of manufacture for wooden gunstocks for use with firearms. More specifically, the invention is directed to an improved method for manufacturing wooden gunstocks from heat treated wood to achieve desirable characteristics for the gunstocks while preserving the aesthetics of natural wood.

2. Description of Prior Art

A gunstock is a part of a firearm that is primarily held by the shooter. It has a rear portion, known as the butt, which generally is rested against the body of the shooter to stabilize the firearm, and a forward portion, known as the fore-end, which attaches to the firing mechanism of the firearm. Firearms manufacturers have historically manufactured gunstocks from wood. Wooden gunstocks are aesthetically unique and naturally beautiful, but they have some characteristics that are difficult for firearm manufacturers to work with. Wooden gunstocks take up and give off moisture depending on the climate and varying weather conditions, resulting in shrinkage and expansion. This shrinking and expansion of a gunstock, however slight, can affect the accuracy of the firearm. Also, some wood that would be otherwise desirable for use in gunstocks, because of hardness, aesthetics, or other characteristics, are too dense, making them too heavy for firearm manufacturing.

As a result of these shortcomings, firearms manufacturers have recently opted for synthetic materials for gunstocks, since synthetic gunstocks offer a lighter gunstock than wood, are more resistant to moisture and rot, and tend to have greater strength than wooden gunstocks. Nevertheless, wooden gunstocks are still desirable, for their aesthetics and tactile qualities, as well as historical fidelity, and therefore a method of manufacture of wooden gunstocks that overcomes the deficiencies of traditional wooden gunstocks is desired.

One method for decreasing the susceptibility of wooden gunstocks to moisture and rot is to chemically treat the wood before fashioning it into a gunstock. A common method of chemically treating wood is the "pressure treatment" method, in which the wood is treated with chemicals such as arsenic and chromium (Chromate Copper Arsenate), alkaline copper quaternary (ACQ), or copper azole preservative, applied to the wood using a vacuum and pressure cycle to force the chemicals deep into the inner portions of the wood. Other chemicals may also be used. While this method tends to improve the weather resistance as well as insect and rot resistance of the wood, it does not address swelling and shrinkage issues. The toxicity of the chemicals used also renders this method less than desirable.

Another method for decreasing the susceptibility of wooden gunstocks to moisture and rot is to treat the wood in a non-pressurized manner with preservatives. These preservatives may be chemically based or derived from naturally occurring compounds, such as oils, and the preservatives are applied to the surface of the wood. While this method tends to be simpler than the pressure treatment method, and potentially uses less toxic preservatives, it fails to ensure a uniform application of the preservative into the inner portions of the wood. It also does not address swelling and shrinkage issues.

There is known in the art yet another method for decreasing the susceptibility of wooden gunstocks to moisture and rot, which is preferable to the above-described methods. Wood may be heat treated prior to being fashioned into a gunstock. European Patent Application EP 0 922 918 A1 (Aug. 3, 1998), to Lallukka, Tero, for "Method for heat treatment of timber", discloses such a method for treating wood.

Wood is made up, generally, of cellulose, lignin, and extractives. Cellulose (and hemicelluloses) are carbohydrates that are structural components in wood. Cellulose constitutes 40-50% and hemicelluloses 25-35% of wood. The composition and contents of hemicelluloses vary from one wood species to another. During heat treatment, both groups undergo changes, but the majority of the changes occur in hemicelluloses. After heat treatment, the wood contains a substantially lower amount of hemicelluloses. As a result of this, the amount of fungi susceptible material is significantly lower, providing one reason for heat-treated woods improved resistance to fungal decay compared with normal kiln dried wood. With the degrading of the hemicelluloses, the concentration of water-absorbing components decreases and the dimensional stability of treated wood is also improved compared to normal kiln dried wood. The decomposition temperature of the hemicelluloses is about 200-260° C., and the corresponding temperature for cellulose is about 240-350° C. Lignin holds the wood cells together. Lignin constitutes 20-30% of wood. During heat treatment, bonds between components of lignin are partially broken. Of all wood's constituents, lignin has the best ability to withstand heat. Lignin's mass starts to decrease when the temperature exceeds 200° C. Wood also contains minor amounts of small-molecule constituents known as extractives. Extractives constitute less than 5% of wood. Extractives are not structural components in wood, and most of the compounds evaporate easily during the heat treatment.

Heat treating wood changes the structure of the wood in a manner which is desirable for the manufacture of gunstocks. During heat treatment, wood undergoes mild pyrolysis, resulting in degradation of hemicelluloses and amorphous cellulose, modification of lignin structures, and evaporation of extractives from the wood. The lignin and hemicelluloses become less hygroscopic. Surface hardness increases, moisture is 10%-50% less than in untreated wood, resins dry out or evaporate, less absorption of moisture occurs, as well as reduced molding, improved weather resistance, and moisture deformation is reduced by 30% to 90% over untreated wood.

Thermally modified wood has a lower density than untreated wood. This is mainly due to the changes of the mass during the treatment when wood loses its weight. Density decreases as higher treatment temperatures are used. This leads to overall lighter weight of the wood, a desirable characteristic for gunstocks. However, the strength of wood has a strong correlation with density. Because thermally modified wood has slightly lower density after the treatment, it is somewhat less strong than untreated wood. However, the change in the weight-to-strength ratio is minimal. The strength of wood is also highly dependent on the moisture content and its relative level below the grain saturation point. Thermally modified wood benefits due to its lower equilibrium moisture content. Heat treated wood is therefore sufficiently strong for use in gunstocks.

Heat treatment also significantly reduces the tangential and radial swelling of wood. Heat-treated wood consequently has very low shrinkage. The water permeability of heat-treated wood is 20-30 percent lower than that of normal kiln dried wood. Thermally modified wood is resistant to insects (which are attracted to the extractives of untreated wood; such extractives are largely evaporated away during heat treatment).

In summary, heat treating wood reduces its moisture content; it reduces the ability of the wood to absorb environmental moisture; it increases the surface hardness of the wood; it increases the overall stability of the wood (that is, minimizes expansion and shrinkage); it causes the wood to become less dense, and therefore lighter; and it makes the wood less susceptible to rot and insect predation. Heat treatment of wood further accomplishes these desirable characteristics without the use of toxic chemicals.

From the foregoing it is evident that there is a need for an improved method of manufacture for wooden gunstocks.

It is therefore an objective of the present invention to provide an improved method of manufacture for wooden gunstocks using heat treated wood.

It is a further objective of the present invention to provide an improved method of manufacture for wooden gunstocks applicable to various species of wood.

It is a further objective of the present invention to provide an improved method of manufacture for wooden gunstocks that reduces the moisture content of the wooden gunstock to minimize expansion and shrinkage and to increase the stability thereof.

It is a further objective of the present invention to provide an improved method of manufacture for wooden gunstocks that makes the wood less susceptible to environmental moisture.

It is a further objective of the present invention to provide an improved method of manufacture for wooden gunstocks that makes the wood less susceptible to rot and insect predation.

It is a further objective of the present invention to provide an improved method of manufacture for wooden gunstocks that decreases the density and therefore the weight of the wood.

It is a further objective of the present invention to provide an improved method of manufacture for wooden gunstocks that increases the surface hardness of the wood.

It is a further objective of the present invention to provide an improved method of manufacture for wooden gunstocks which does not use toxic chemicals to treat the wood.

Other objectives of the present invention will be readily apparent from the description that follows.

SUMMARY

The present invention discloses an improved method of manufacture for wooden gunstocks. In one aspect, the present invention is directed to a method comprising the steps of obtaining a piece of wood of an appropriate species of tree; drying said piece of wood until said piece of wood has a moisture content of less than fifteen percent; placing said piece of wood into an oven heated to between 180° C. and 240° C.; allowing said piece of wood to be heated by the oven for between 2 and 96 hours such that said piece of wood achieves a temperature of at least 180° C.; removing said piece of wood from the oven and allow said piece of wood to cool to substantially room temperature; and cutting said piece of wood into a rough gunstock blank.

In an alternate aspect of the present invention, the method comprises the steps of obtaining a pre-fabricated wooden gunstock blank; drying said wooden gunstock blank until said wooden gunstock blank has a moisture content of less than fifteen percent; placing said wooden gunstock blank into an oven heated to between 180° C. and 240° C.; allowing said wooden gunstock blank to be heated by the oven for between 2 and 96 hours such that said wooden gunstock blank achieves a temperature of at least 180° C.; and removing said wooden gunstock blank from the oven and allow said wooden gunstock blank to cool to substantially room temperature.

Other features and advantages of the invention are described below.

DESCRIPTION OF THE INVENTION

Figure 1:
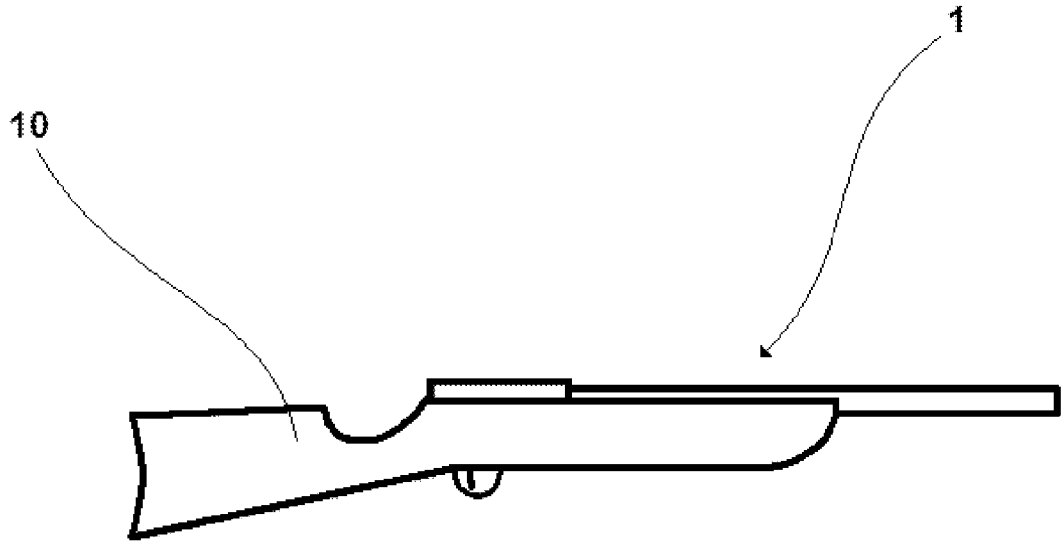
FIG. 1 is a side view of a gunstock fitted onto a firearm.
Figure 2:
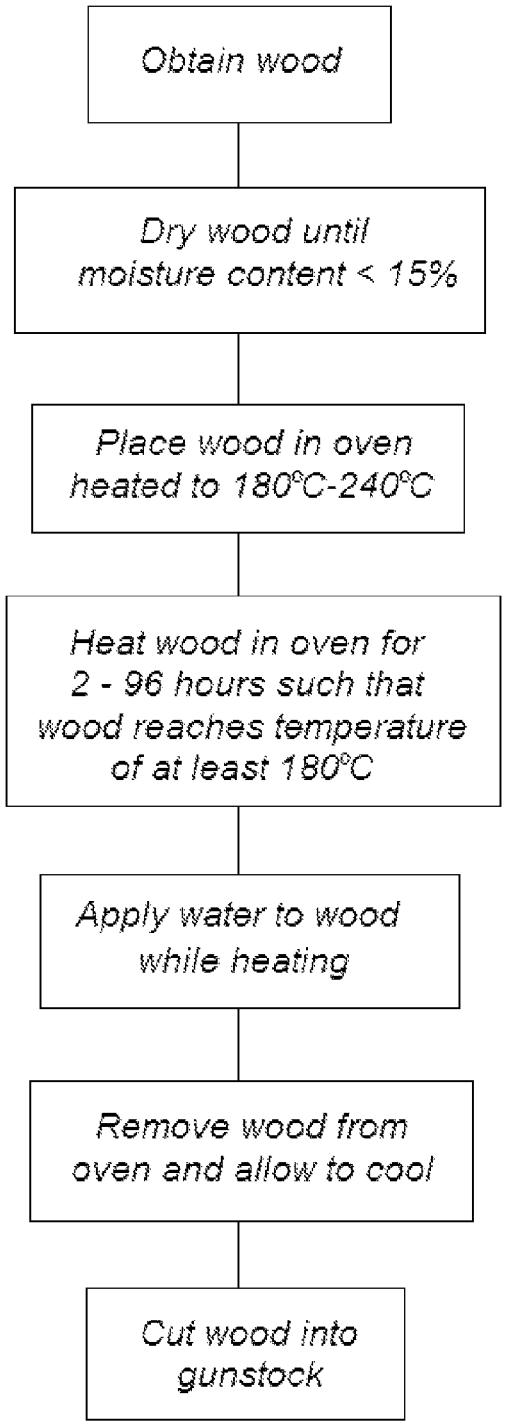
FIG. 2 is a flow chart of the steps of one embodiment of the method.

The method disclosed herein is for the manufacture of a gunstock 10 for a firearm 1. The basic method comprises the following steps:

A. obtain a piece of wood of an appropriate species of tree having a thickness of between two and five inches and a length of between six and seventy inches;

B. dry said piece of wood until said piece of wood has a moisture content of less than fifteen percent;

C. place said piece of wood into an oven heated to between 180° C. and 240° C.;

D. allow said piece of wood to be heated by oven for between 2 and 96 hours such that said piece of wood achieves a temperature of at least 180° C.;

E. remove said piece of wood from oven and allow said piece of wood to cool to substantially room temperature; and F. cut said piece of wood into rough gunstock blank.

The foregoing Steps A through F are to be performed consecutively.

Referring to Step A, the piece of wood should be chosen from an appropriate species of tree having certain characteristics desirable for the manufacture of gunstocks 10, namely, hardness, strength, and stability, and the wood should be aesthetically pleasing. Suitable species of tree include the American Beech (*Fagus Grandifolia*), Red Maple (*Acer Rubrum*), Black Walnut (*Juglans Nigra*), Hard maple (*Acer Saccharum*), Turkish Walnut a/k/a English Walnut (*Juglans Regia*), California Walnut (*Juglans Californica*), Yellow Birch (*Betula Alleghaniensis*), and Claro Walnut (*Juglans Hindsii*). The quality of the wood from these species may vary, with the higher grades having "curly figure" natural designs in the wood that shimmer in the light and are very attractive. Wood from other species of tree may also be used.

In order to manufacture a gunstock 10, the wood must be of an appropriate thickness and length. A thickness of between two and five inches is generally appropriate, with a preferred thickness of between two and three inches. A length of between six and seventy inches is appropriate, depending on the type of firearm: a pistol may require a very short gunstock 10, while a Kentucky Long Rifle may require a gunstock 10 exceeding five feet in length. Where appropriately dimensioned wood may be difficult to obtain, the method of the present invention is modified to comprise two additional preliminary steps. These steps are:

A'. obtain a log of an appropriate species of tree; and

A". cut a piece of wood from said log to a size appropriate for use in Step A.

Step A' is performed before Step A" and Step A" is performed before Step A. The wood may be cut in Step A" by any practical means known in the art, including with hand tools, power tools, computer-controlled cutting devices, and the like.

Referring to Step B, the piece of wood is dried until it has a moisture content of less than fifteen percent. The drying can be performed by any means known in the art, including air drying, kiln drying, or other means. While the moisture content can be any amount less than fifteen percent (15%), the dryer the wood the better, with a moisture content of ten percent (10%) or even five percent (5%) being desirable.

Referring to Step C, the dried piece of wood is placed into an oven heated to between 180° C. and 240° C. The oven may be any type of oven known in the art which can attain the appropriate temperatures and maintain substantially constant temperatures over time. The oven may be preheated to the desired temperature before the wood is placed therein, or it may be preheated to a preliminary, lower temperature before the wood is placed therein and thereafter heated to the desired temperature, or it may not be preheated at all, with the wood being placed in a cold oven and then the oven temperature raised to the desired temperature. In the preferred embodiment, the oven will be preheated to an intermediate temperature, preferably in excess of 100° C. The wood will be placed into the oven and then the oven temperature will be gradually raised to the desired temperature, at a substantially constant rate of increase. The preferred temperature is between 200° C. and 230° C.

Referring to Step D, the piece of wood remains in the oven to be heated at the desired temperature for between 2 and 96 hours such that the piece of wood achieves an internal temperature of at least 180° C. In the preferred embodiment the wood is heated for 36 to 72 hours, depending on the amount of wood in the oven and the species. The oven will be maintained at substantially the preferred temperature for the duration of Step D.

In one embodiment of the method, an additional Step D' is performed, concurrently with Step D. In Step D', while the piece of wood is being heated in the oven in Step D, a treatment is applied to the wood. The treatment may be any substance which enhances the structural changes occurring to the wood during heating. In the preferred embodiment the treatment is a coolant. The application of a coolant to the wood protects the surface of the wood from scorching. Because the outer surface of the wood becomes heated before the inner core of the wood, the prolonged exposure to heat necessary to heat the inner core of the wood could raise the outer surface to excessive temperatures, potentially resulting in surface damage. The coolant attenuates the surface temperature of the wood to prevent excessive heating thereof. Any form of liquid or gaseous coolant may be used. In one embodiment the preferred coolant is water. Water may be applied in liquid form to the wood during Step D. In the preferred embodiment water is applied to the wood in the form of steam. In other embodiments chemical treatments can be applied to the wood to protect the surface. The treatment may be applied continuously, or in the preferred embodiment it may be applied periodically to the wood. The timing of the application of treatment to the wood may be computer controlled to achieve the desired surface temperature of the wood for maximum protection during heating.

Referring to Step E, after the wood has been heated for the desired length of time it is removed from the oven and allowed to cool. In one embodiment the wood is simply removed from the oven without first lowering the oven temperature. In another embodiment the oven temperature is lowered prior to the removal of the wood. In this embodiment the oven temperature will be gradually lowered to an intermediate temperature, preferably in excess of 100° C., with the lowering of the oven temperature occurring at a substantially constant rate. In the most preferred embodiment the rate of decrease in temperature will be substantially the same as the rate of increase in temperature at the beginning of Step D. Once the intermediate temperature is reached the wood is removed from the oven. In all embodiments, once the wood is removed from the oven it is allowed to cool to substantially room temperature. This cooling process may be accelerated by moving cool air over the wood by the use of fans, or by placing the wood into a cooled space, such as a refrigeration unit. Alternatively, the wood may be allowed to cool simply by leaving it out in a storage area.

Referring to Step F, once the wood has suitably cooled it is cut into a rough gunstock blank. The wood may be cut in Step F by any practical means known in the art, including with hand tools, power tools, computer-controlled cutting devices, and the like. The gunstock blanks are then either sold as rough blanks or they are cut and finished. In the preferred embodiment, during an additional Step G, finished gunstocks are created from rough gunstock blanks by use of a computerized finishing machine.

An alternate method is disclosed herein for the manufacture of a gunstock 10 for a firearm 1. The alternate method comprises the following steps:

A. obtain a wooden gunstock blank fashioned from wood of an appropriate species of tree;

B. dry said gunstock blank until said gunstock blank has a moisture content of less than fifteen percent;

C. place said gunstock blank into an oven heated to between 180° C. and 240° C.;

D. allow said gunstock blank to be heated by oven for between 2 and 96 hours such that said gunstock blank achieves an internal temperature of at least 180° C.; and E. remove said gunstock blank from oven and allow said gunstock blank to cool to substantially room temperature;

The foregoing Steps A through E are to be performed consecutively.

Steps B through E may be varied or augmented as described above with regard to the basic method.

An optional Step F may be performed after Step E, whereby once the gunstock blank has suitably cooled it is cut and finished into a finished gunstock. In the preferred embodiment, during Step F finished gunstocks are created from rough gunstock blanks by use of a computerized finishing machine.

Modifications and variations can be made to the disclosed embodiments of the method without departing from the subject or spirit of the method as defined in the following claims.

We claim:

1. An improved method of preparing a wooden gunstock, said method comprising the following steps:

A. obtain a piece of wood having a thickness of between two and five inches and a length of between six and seventy inches;

B. dry said piece of wood until said piece of wood has a moisture content of less than fifteen percent;

C. place said piece of wood into an oven heated to between 180° C. and 240° C.;

D. allow said piece of wood to be heated by oven for between 2 and 96 hours such that said piece of wood achieves an internal temperature of at least 180° C.;

E. remove said piece of wood from oven and allow said piece of wood to cool to substantially room temperature; and F. cut said piece of wood into rough gunstock blank;

whereby Steps A through F are to be performed consecutively.

2. The method of claim 1 wherein the piece of wood obtained in Step A is chosen from the group of the following species of tree:

American Beech (*Fagus Grandifolia*), Red Maple (*Acer Rubrum*), Black Walnut (*Juglans Nigra*), Hard maple (*Acer Saccharum*), Turkish Walnut a/k/a English Walnut (*Juglans Regia*), California Walnut (*Juglans Californica*), Yellow Birch (*Betula Alleghaniensis*), and Claro Walnut (*Juglans Hindsii*).

3. The method of claim 1 further comprising the following step:

G. create finished gunstock from rough gunstock blank;

whereby Step G is performed after Step F.

4. The method of claim 3 wherein the gunstock blank is finished in Step G by use of a computerized finishing machine.

5. The method of claim 1 further comprising the following steps:

A'. obtain a log from a tree; and

A". cut a piece of wood from said log to a size appropriate for use in Step A;

whereby Step A' is performed before Step A" and Step A" is performed before Step A.

6. The method of claim 5 wherein the log obtained in Step A' is chosen from the group of the following species of tree:

American Beech (*Fagus Grandifolia*), Red Maple (*Acer Rubrum*), Black Walnut (*Juglans Nigra*), Hard maple (*Acer Saccharum*), Turkish Walnut a/k/a English Walnut (*Juglans Regia*), California Walnut (*Juglans Californica*), Yellow Birch (*Betula Alleghaniensis*), and Claro Walnut (*Juglans Hindsii*).

7. The method of claim 1 wherein the wood dried in Step B is dried in a kiln.

8. The method of claim 1 wherein the wood dried in Step B is air dried.

9. The method of claim 1 wherein the wood heated in Step D is heated for between 36 and 72 hours.

10. The method of claim 1 further comprising the following step:

D'. during Step D, apply a treatment to said piece of wood;

whereby Step D' is performed concurrently with Step D.

11. The method of claim 10 wherein the treatment applied in Step D' is a coolant.

12. The method of claim 11 wherein the coolant applied in Step D' is water.

13. The method of claim 12 wherein the water applied in Step D' is in the form of steam.

14. The method of claim 12 wherein the water applied in Step D' is in liquid form.

15. The method of claim 10 wherein the treatment in Step D' is applied periodically to the piece of wood.

16. The method of claim 10 wherein the treatment applied in Step D' is applied continuously to the piece of wood.

17. An improved method of preparing a wooden gunstock, said method comprising the following steps:

A. obtain a log of a certain species of tree chosen from the group of the following species of tree:

American Beech (*Fagus Grandifolia*), Red Maple (*Acer Rubrum*), Black Walnut (*Juglans Nigra*), Hard maple (*Acer Saccharum*), Turkish Walnut a/k/a English Walnut (*Juglans Regia*), California Walnut (*Juglans Californica*), Yellow Birch (*Betula Alleghaniensis*), and Claro Walnut (*Juglans Hindsii*);

B. cut a piece of wood from said log to a size having a thickness of between two and five inches and a length of between six and seventy inches;

C. dry said piece of wood in a kiln until said piece of wood has a moisture content of less than fifteen percent;

D. place said piece of wood into an oven heated to between 180° C. and 230° C.;

E. allow said piece of wood to be heated by oven for between 36 and 72 hours such that said piece of wood achieves a temperature of at least 180° C. Celsius;

E'. during Step E, above, periodically apply water in the form of steam to said piece of wood;

F. remove said piece of wood from oven and allow said piece of wood to cool to substantially room temperature;

G. cut said piece of wood into rough gunstock blank; and

H. create finished gunstock from rough gunstock blank by use of a computerized finishing machine;

whereby Steps A through H are to be performed consecutively, except for Step E', which is performed concurrently with Step E.

18. An improved method of preparing a wooden gunstock, said method comprising the following steps:

A. obtain a gunstock blank fashioned from wood;

B. dry said gunstock blank until said gunstock blank has a moisture content of less than fifteen percent;

C. place said gunstock blank into an oven heated to between 180° C. and 240° C.;

D. allow said gunstock blank to be heated by oven for between 2 and 96 hours such that said gunstock blank achieves an internal temperature of at least 180° C.; and E. remove said gunstock blank from oven and allow said gunstock blank to cool to substantially room temperature;

whereby Steps A through E are to be performed consecutively.

19. The method of claim 18 wherein the gunstock blank obtained in Step A is made from wood chosen from the group of the following species of tree:

American Beech (*Fagus Grandifolia*), Red Maple (*Acer Rubrum*), Black Walnut (*Juglans Nigra*), Hard maple (*Acer Saccharum*), Turkish Walnut a/k/a English Walnut (*Juglans Regia*), California Walnut (*Juglans Californica*), Yellow Birch (*Betula Alleghaniensis*), and Claro Walnut (*Juglans Hindsii*).

20. The method of claim 18 further comprising the following step:

F. create finished gunstock from gunstock blank;

whereby Step F is performed after Step E.

* * * * *